US007637572B1

(12) United States Patent
Cirami

(10) Patent No.: US 7,637,572 B1
(45) Date of Patent: Dec. 29, 2009

(54) COMPACTLY FOLDABLE SKYWATCHER'S TRIPOD

(76) Inventor: Salvatore Cirami, 12-21 35th Ave., Apt. 4F, Long Island City, NY (US) 11106-4729

( * ) Notice: Subject to any disclaimer, the term of this patent is extended or adjusted under 35 U.S.C. 154(b) by 20 days.

(21) Appl. No.: 12/151,272

(22) Filed: May 6, 2008

Related U.S. Application Data

(63) Continuation-in-part of application No. 11/483,363, filed on Jul. 10, 2006, now abandoned.

(51) Int. Cl.
*A47C 1/12* (2006.01)
*A47C 7/62* (2006.01)
*A47C 4/00* (2006.01)

(52) U.S. Cl. ..... 297/451.2; 297/217.2; 297/16.2

(58) Field of Classification Search ..... 33/275 R; 248/170; 297/195.11, 16.2, 217.1, 451.2, 297/217.2, 16.1, 344.21, 183.5, 183.1, 186, 297/188.21, 188.01
See application file for complete search history.

(56) References Cited

U.S. PATENT DOCUMENTS

| | | | | | |
|---|---|---|---|---|---|
| 1,829,614 | A | * | 10/1931 | Schier | 33/275 R |
| 2,669,784 | A | * | 2/1954 | Lewis, Jr. | 33/275 R |
| 2,746,154 | A | * | 5/1956 | Lewis, Jr. | 33/275 R |
| 4,318,567 | A | * | 3/1982 | Guthier | 297/184.16 |
| 4,637,536 | A | | 1/1987 | Wong | |
| 4,744,536 | A | | 5/1988 | Bancalari | |
| 5,489,142 | A | * | 2/1996 | Mathieu | 297/327 |
| 5,628,546 | A | | 5/1997 | Boetzkes | 297/316 |
| 5,803,547 | A | * | 9/1998 | Brown | 297/344.23 |
| 6,007,032 | A | | 12/1999 | Kuo | |
| 6,102,479 | A | | 8/2000 | Wallace | 297/357 |
| 6,224,153 | B1 | | 5/2001 | Vodinh | |
| 6,283,421 | B1 | | 9/2001 | Eason et al. | 248/170 |
| 6,676,208 | B2 | * | 1/2004 | Lu | 297/188.2 |
| 6,895,709 | B1 | | 5/2005 | Krien et al. | |
| 6,971,687 | B2 | | 12/2005 | Amy | 292/128 |
| 7,004,437 | B2 | | 2/2006 | Bauer et al. | 248/282.1 |
| 7,069,694 | B2 | | 7/2006 | Fullick | 49/183 |
| 7,134,719 | B2 | | 11/2006 | Moglin et al. | 297/217.3 |
| 2004/0100132 | A1 | | 5/2004 | Sligh | |
| 2005/0127724 | A1 | | 6/2005 | Irwin et al. | 297/188.01 |

* cited by examiner

*Primary Examiner*—Milton Nelson, Jr.

(57) ABSTRACT

A skywatcher's tripod has a seat mounted on a rider support that swivels 360 degrees on a base having upwardly foldable tripod legs. A post forms a forward end of the rider support. An extension arm configured to secure a tripod head for attachment of a surveillance device is axially slidable in a holder that is pivotally secured to the upper end of the post for rotation towards the seated user. The user sights on targets from horizon to zenith depending on the rotated position of the holder and the extension of the arm. The seat folds against the post outboard of the folded tripod legs and is held in folded position by a folded leg that abuts a handle that extends from a bottom side of the seat. The rider support includes a swivel lock and a combination holder/extension arm lock.

4 Claims, 6 Drawing Sheets

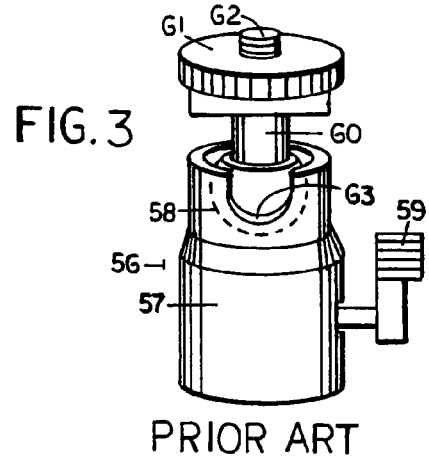
FIG. 3
FIG. 4
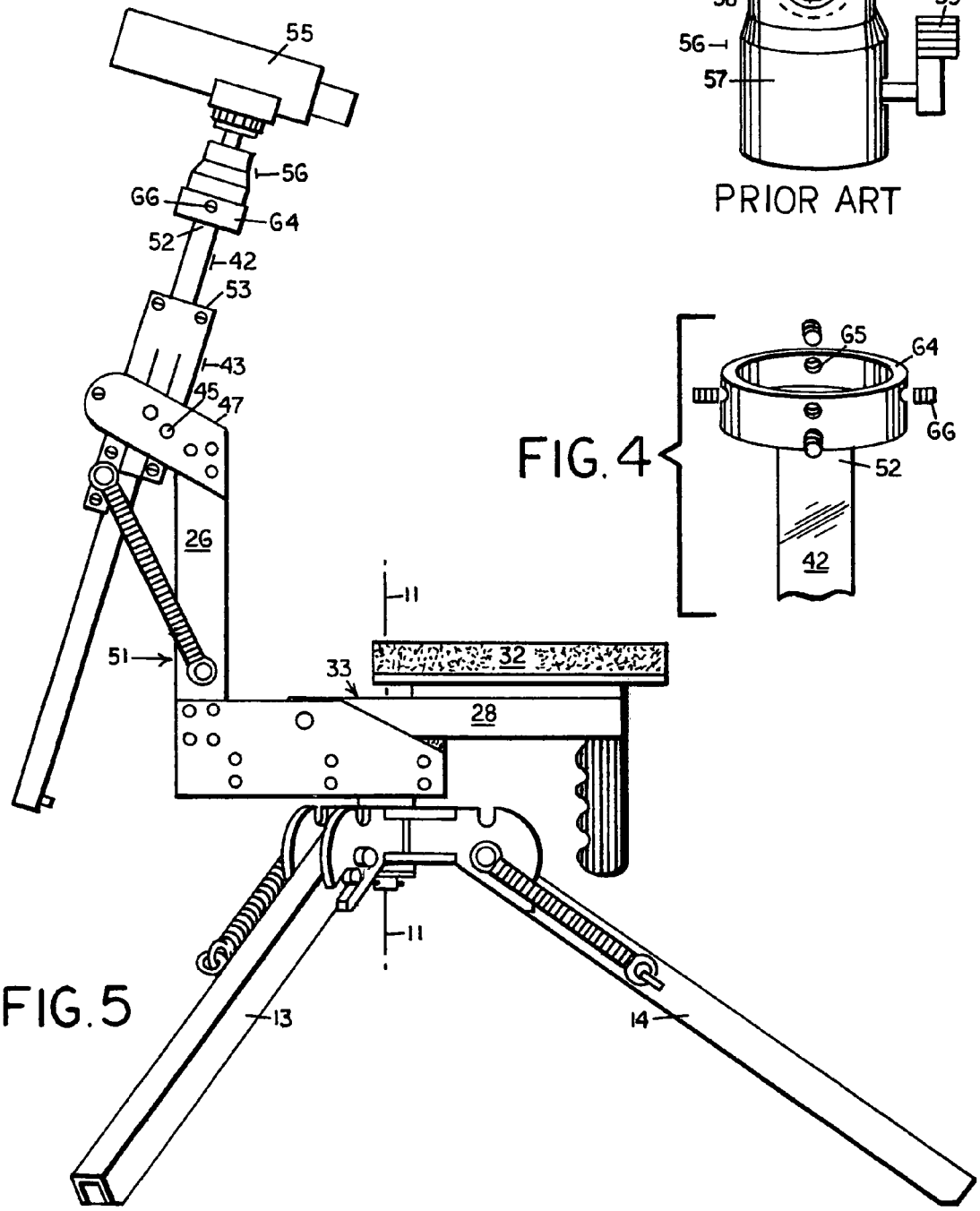
FIG. 5

PLANE OF SYMMETRY
46
70
71
72
73
43
81
S2
S3
82
76
49
50
45
44
75
80
79
47
48
76
74
86
88
89
35
110
111
26
112
113
114
33
24
42
28
92
109
31
93
25T
30
94
27
11
29
38
25
104
115
102
106
105
103
107
87
54
108
46
95
101
96
11
99

COMPACTLY FOLDABLE SKYWATCHER'S TRIPOD

CROSS-REFERENCE TO RELATED APPLICATION

This disclosure is a Continuation-in-Part filed with an original application Ser. No. 11/483,363 filed Jul. 10, 2006, now abandoned. Benefit of earliest filing date is claimed for common subject matter.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

This invention pertains to skywatching apparatus used to provide a steady support for a surveillance device such as a binocular, telescope, camera or camcorder.

2. Background Art

The conventional tripod commonly used for support of a telescope, binocular, camera, etc., is fine for training on a relatively stationary target such as a star but is severely limited for dynamic use acquiring and tracking a moving target such as a bird, airplane or unidentifiable object which may circle the observer's position and even pass overhead. Accordingly, it may be said that there are two different types of skywatching: static and dynamic. Dynamic skywatching requires the capacity to swivel 360 degrees while being able to quickly vary the elevation of the scope, camera or other surveillance device so as to aim it anywhere from ground level to directly overhead. The conventional tripod does not serve this market. Conventionally one stands behind the tripod with limited ability to pan the horizon, which can be boring and a discouragement to the casual skywatcher, and usually requires bending over to sight through a substantially straight line-of-sight surveillance device such as a binocular, which puts a strain on one's back. The conventional tripod does not incorporate a seat. Currently the best the industry has to offer for user comfort is a folding chair which, obviously, the skywatcher has to carry to the viewing site along with the tripod. For viewing subjects at higher elevations, conventional tripods incorporate a vertically movable column that can be cranked up and which has its upper end carrying the tripod head on which the surveillance device is mounted. This may make the tripod top-heavy, and if the user is standing, the column may not be raisable high enough for accessing the surveillance device's eyepiece without crouching, and close placement of a chair for sitting under the surveillance device is limited by interference with the tripod's legs and further restricts panning. For viewing targets at the zenith the industry offers a boom, a counterweighted end of which is secured to the tripod and the opposite free end of which carries the scope or binocular, the user standing or sitting under the free end of the boom. Besides being inconvenient with respect to the number of separate pieces of equipment which must be carried to the viewing site, this recourse still does not permit the user to swing about the horizon looking for a subject of interest; in order to do that he will have to step around the tripod (with risk of tripping on its legs) while repositioning the boom and the chair. Compensating for these limitations telescopes and spotting scopes are available having their eyepiece fixed at or adjustable to a 45 or 90 degree angle relative to the line-of-sight of the device so that the user need not tilt his head so for backward in order to look overhead, but such offset viewing is counter-intuitive, especially for the occasional user, and therefore a handicap when one is trying to quickly acquire a moving target. Binoculars still require sighting straight through the binocular.

The prior art has long sought to provide skywatchers with a support means including a swivel seat for searching 360 degrees about the user's location from horizon to zenith. The approach has been to provide the surveillance device mounted on an arm structure that rises from a position behind the seated user's back, swiveling with the seat, and overhanging and/or encircling the user, a free end of the arm structure holding the surveillance device in front of the user. This approach has proven impractical due to problems having to do with confinement of the seated skywatcher, obstruction of peripheral vision and proper alignment of the surveillance device's eyepiece with the user's eyes at different elevations of the surveillance device, as well as excessive weight due to complexity adversely affecting hand-carried portability or requiring assembly of parts at the skywatching site. The following prior art testifies to this history.

U.S. Pat. No. 4,637,536 entitled "Personal Binocular Support", issued to Wilbur Wong, Jan. 20, 1987, discloses a binocular support that is worn by the user attached to the user's torso and so does not anticipate the structure of the present invention, but is of interest for its description of the prior art by referencing articles which appeared in issues of Sky and Telescope magazine ranging from January 1974 to February 1985. Pertinent paragraphs are quoted below:

"The problem of holding binoculars still enough for effective usage has long been recognized by astronomers. The most common method of overcoming this problem is to mount the binoculars to a common photographic tripod. While this approach solves the problem of unsteadiness, the tripod itself usually interferes with the position that the body of the user must assume when viewing objects at an angle of altitude from the horizon. Furthermore, few tripods are sufficiently tall enough to position the binoculars high enough for a tall user, when the user is looking up from a standing position.

"Accordingly the literature reveals various efforts to construct tripod attachments that mitigate the drawbacks of standard tripods. One such design, due to Steve Kufeld of Huntington Beach, Calif., is noted in the August 1979 issue of Sky and Telescope magazine, at pages 10 and 112.

"Kufeld's device, a counterbalanced mounting atop a heavy-duty tripod, is illustrated in use by a photograph of a person sitting on a stool and looking through a pair of binoculars fixed to the mounting. Through [sic] this apparatus is apparently of considerable utility, the photograph itself shows a principal disadvantage of such devices, as the user leans forward awkwardly from the stool to bring his eyes to the appropriate distance from the fixed tripod. Presumably the stool could be moved to a better position for at least some viewing angles; however, the picture also suggests another drawback—namely, that movement of the stool (or of the user's position if standing) is required to change the vertical viewing angle.

"Another tripod design aimed at overcoming this latter drawback is described by Rudolf Mandler of Deubach, West Germany, in the July 1982 issue of Sky and Telescope at pages 89 and 90. Mandler's tripod mount has an 'inverted yoke' that carries the binoculars in such a way that 'the binoculars swing in a vertical plane around a pivot at [the] [sic] neck.' By virtue of this action, it is 'possible to view objects all the way to the zenith without twisting [the] [sic] body.' This swinging action is a very important feature of Mandler's tripod and will be discussed further below.

"A less common but frequently publicized approach has been to build special chairs or chair attachments that support the binoculars through mechanical arms and brackets. Such arrangements provide more comfortable viewing positions for the user's body, particularly at higher viewing angles.

"Chris Baetens, of Boechout, Belgium, offers one of the simplest of such devices, shown in the February 1985 issue of Sky and Telescope at page 171. His device is made from an old revolving desk chair fitted with an adjustable framework to support the user's back, as the user assumes a near-reclining position to view the stars. Casters under the entire assemblage permit the user to swivel the chair, and adjustable arms support the binoculars above the back portion.

"Once the binocular support arms and the back framework are properly adjusted for the particular user's comfort and for the desired altitude angle, such a device supports the binoculars steadily, relieving the user's hands of this task. It of course offers considerable viewing satisfaction for the amount of design and construction effort invested. To change viewing angles, however, the user apparently must get up, adjust the back framework and probably the support arms as well, and then get back into the apparatus under the support arms.

"John Talbot, of Camarillo, Calif., writing in the same publication at page 172, has described a system that avoids this necessity. His chair rocks for altitude variation and rotates in azimuth, permitting a good view of the sky from about twenty-five degrees of altitude to the zenith—with one stop for chair adjustment along the way.

"Pearson Menoher, of Greenwich, Conn., in the January 1974 issue of Sky and Telescope at pages 51 through 55, discloses a more elaborate apparatus that eliminates the need for getting up and sitting back down to make adjustments. His apparatus is a motorized observing chair which tilts about a vertical axis for altitude-angle variation, and which rides a wheel-and-truck suspension for azimuth variation. The azimuth system is driven by a third-horsepower electric motor. This system may represent the ultimate in investment for binocular-viewing comfort, though perhaps not the ultimate in design elegance.

"Emphasizing the latter, or at least aiming to make the most of a much more modest investment in time and materials, are observing-chair designs introduced by John Riggs, of Kenmore, N.Y., and by Burt Leifer of Fort Wayne, Ind. These appear in Sky and Telescope for, respectively, February 1981 (pages 162 through 164) and May 1979 (pages 487 and 488).

"Each of these two approaches provides a chair with a simple azimuthal pivot about a vertical axis, and more importantly (as will be seen) a vertical swinging action of the binoculars themselves about a horizontal axis that is generally adjacent to the user's neck.

"Most of the tripods and chair brackets discussed above are difficult to adjust when changing viewing angles. These devices frequently require several separate adjustments to obtain the right position in both height and angle. The Mandler tripod and the Riggs and Leifer chairs minimize these problems by the swinging action of the binoculars about axes adjacent to the viewer's neck.

" . . . [paragraphs omitted].

"The multiple-adjustment problems mentioned above, as recognized by Mandler, Riggs, Leifer and others, arises from these translational and rotational movements. These natural movements of a person's head cause the eye position to traverse an arc when the head moves between a horizontal and an elevated viewing position. For present purposes this arc may be regarded as very roughly circular, with an apparent or effective center of motion that is near the person's neck.

"Thus both Mandler's tripod-attachment "yoke" and the binocular-supporting "fork" of Riggs' and Leifer's chairs pivot about axes adjacent the user's neck. The location of the pivot axis relative to the user's body is discussed explicitly by both Riggs and Leifer. In each case the binocular eyepiece, being fixed to the yoke or fork, revolves about the same respective axis. As shown in Mandler's illustrations, however, the line of sight itself—that is, the centerline of the ocular—preferably does not pass through that mechanical-rotation axis.

" . . . [paragraphs omitted].

"Although of course the device is used generally in darkness, nonetheless there will remain for many users a continuing sensation of being enclosed or even confined. The crossbar and the swinging-structure side elements together form a moving cage, always occupying both sides of the user's peripheral vision. In other words, these tend toward the claustrophobic. This tendency is badly aggravated by the requirement that while viewing the user keep his body in practically the same position relative to the tripod or chair.

"Fifth and finally, all of the tripod and chair-bracket systems—even those of Mandler, Riggs and Leifer—are limiting in that their size and in some cases their weight inhibit the user's freedom of movement."

End of quotations from the Wong patent. These back issues of Sky and Telescope magazine are no longer available for purchase and so the articles referred to in the Wong patent have not been directly examined and any photograph or illustration provided therein has not been seen by the instant inventor. However, recently introduced is a skywatching chair along the lines of those described above described as follows in a New York Times article dated Aug. 25, 2005:

"The StarSeeker chair from Bigha (bigha.com), an admittedly geeky contraption, aims to make stargazing comfortable. The $1,950 package consists of a rugged aluminum base, collapsible lounge chair, adjustable binocular mount and small battery-powered motor. It fits easily into a car trunk and assembles in a couple of minutes.

"The chair reclines smoothly under body pressure, and the viewing controls are easily operated in the dark. The counterweighted binocular bar allows a range of vertical motion, from just above the horizon to directly overhead. The motor, controlled by a small joystick, gently rotates the chair at variable speeds."

The material quoted above shows that the prior approach has been to provide the surveillance device mounted on an arm structure that rises from behind the seated user, usually attached to a backrest, and to have such arm structure extending over or around the user, resulting in the undesirable sense of confinement discussed above. The present improvement solves all the problems previously experienced by effectively reversing the prior arrangement: the invention mounts the surveillance device on an arm structure that rises from a position IN FRONT OF the seated user, thereby leaving the areas to either side of and behind the user open, thereby providing the user with an unobstructed view of the area surrounding his position whereby a target approaching from a direction other than where the observer is currently looking can be spotted, and making it easy to get on and off the tripod because there no longer is any obstructing structure overhanging the seat. Further advantages are structural simplicity minimizing weight and enabling foldability to compact proportions for carrying by hand and not requiring assembly but simply unfolding for immediate use.

Referenced below is other prior art not pertaining to sky-watching apparatus but showing elements relating to the present mode of attainment.

Bancalari, "Collapsable Pole And Stand Combination", U.S. Pat. No. 4,744,536, issued May 17, 1988, discloses a pole having leg members pivotally secured between pairs of lug members forming part of a base, the lug members being provided with notches and the leg members with pins received in the notches whereby a leg detent means is effected for securing the leg members in alternative folded and unfolded positions, the leg members being foldable upwardly parallel to the pole and including spring means biasing the leg members into engagement with the notches. A similar means is used in the present invention. The preamble of Claim 1 appended hereto recites this structure as prior art forming a setting for the portion improved upon.

Sligh, "Drummer Seating System", Patent Application Publication No. US 2004/0100132 A1 published May 27, 2004, anticipates the broad idea of a swivel seat wherein a payload (in this instance a drum) is mounted on an arm structure that is located in front of and swivels with the seat so that the seat is thereby effectively a saddle seat. The broadest claim presented herein is restricted to structure that differs from that disclosed by Sligh as necessary to give physical expression to a concept that is different from that envisioned by Sligh. The result conceived by Sligh is the support of one or more drums (which may be fairly large in diameter as shown in Sligh's drawings) and the drums must be carried at a low enough elevation that the drum can be played. Sligh provides a seat fixed to a "mounting block 22" that swivels on the upper end of a column that is held upright on three or four foldable legs. Sligh provides an "angled supporting arm 3" that is fixed at one end to the mounting block and extends forwardly therefrom a considerable distance as necessary to accommodate a drum of large diameter. The supporting arm has an offset configuration such that a straight free end portion of the arm is at a much lower elevation than is the end that is attached to the mounting block. "A vertical drum support post 1 is adjustably attached along the distal end of the angled supporting arm 3 via a screw clamp junction 25." (Sligh [0026].) The support post 1 stands alongside the supporting arm 3 (as opposed to standing on top of it), and, is slidable axially of the distal end of the supporting arm 3 by loosening and then tightening the screw clamp junction 25. This axial adjustability of the standing position of the support post 1 evidently is necessary in order to position a drum closer to or further away from the seated musician depending on the diameter of the drum. Finally, the drum is mounted on a second clamp that is provided at the upper end of the support post and this second clamp is pivotally adjustable so that the tilt angle of the drum can be adjusted. Accordingly, the result conceived by Sligh is characterized in part by the idea of enabling a seated drummer to swivel left or right with the drum remaining in front of him at a suitably low elevation. As shown in Sligh's drawings, the attainment of this result requires the upper end of the "drum support post 1" to terminate at the elevation of the seat pad 12, FIG. 2. The offset or angled configuration of the supporting arm 3 is necessary to attain that result. The second clamp at the top of the drum support post that secures the drum is made pivotal for the sole purpose of giving physical expression to an idea that the tilt angle of the drum should be adjustable. This contrasts with the invention tripod wherein a pivotal connection at the upper end of the post member in cooperation with an extension arm functions to enable all those elevations of the surveillance device which are above the horizon. The present invention differs from Sligh as discussed below.

The result conceived by the present invention is that of supporting a surveillance device as steadily as possible at elevations ranging from the eye level of the seated user for sighting on targets located on the horizon, and at increased elevations all the way to the zenith. This result conceived is further characterized by the idea of the structure which gives physical expression to that result conceived being compactly foldable comparable to a conventional heavy duty photographer's or surveyor's tripod. That structure as most broadly claimed herein, requires (a) an L-shaped rider support comprising an elongate main member of given length and an elongate post member having a length that is longer than that of said main member secured to the forward end of the main member, the main member being pivotally secured to a base for rotation 360 degrees about a swivel axis, the base having upwardly foldable tripod legs; (b) the rider support having a plane of symmetry that extends lengthwise of the main member and includes the post member and the swivel axis; (c) having a seat fixed to an elongate seat support member that is positioned on a top side of and extends lengthwise of the main member centered on the said plane of symmetry, the seat support member having a forward end pivotally secured to the main member for rotation about a seat pivot axis that is perpendicular to the said plane of symmetry and is located such that the seat is foldable against a rearward side of the post member for compact foldability; (d) wherein a holder carrying an extension arm (that is relatively short for compact foldability) is pivotally secured to an upper end of the post member, the post member being longer than the main member in order to (1) position a surveillance device mounted on the extension arm at the eye level of a seated user for sighting on targets located on the horizon and (2) enable the extension arm to pivot (via the holder) from an elevation that is high enough that the extension arm when extended can position the surveillance device overhanging the seated user's head for sighting on targets at the zenith; (e) the extension arm and its holder being centered on the plane of symmetry in order that the surveillance device will be positioned on a logically centered line-of-sight; (f) wherein the tripod legs are long enough that when the seat and legs are in their respective unfolded positions, the seat is located wholly inboard of an imaginary straight line drawn between the free ends of any two of the leg members in order that the tripod will be safely usable on a gradient without the user falling over backwards; and (g) wherein (for most compact foldability) the main member has a length so short as measured from the swivel axis to the post member that foldability of the tripod legs requires (1) folding the seat against the post member as stated above and also (2) centering the rider support between two of the legs in order that a bottom surface of the seat will clear the planes of foldability of the said two legs so that when the said two legs are standing upright in their folded position the folded seat is located immediately outboard of the said two leg members.

Kuo, "Foldable Stand Assembly For Microphones", U.S. Pat. No. 6,007,032, issued Dec. 28, 1999, discloses a lower pole section standing on upwardly foldable and securable legs but having an upper pole section that is axially slidable within a holder that is pivotally secured to the lower section of the pole, the upper end of the extendible pole being configured to hold a microphone which can be leaned toward the user by pivoting the holder relative to the lower section of the pole, but this can only be done after the upper pole section is lifted entirely free of the lower section of the pole because in fully retracted position the upper pole section is received inside the lower section of the pole. The Kuo patent also illustrates art prior to the patent pertaining to a stand comprising a first pole that rises from tripod legs, having a telescopically contained second pole mounted in the first pole, an upper end of the second pole having a holder clamped onto it which in turn carries a third pole that is axially slidable within the holder, the third pole being held parallel to but laterally spaced apart from the main pole structure, the third pole being rotatable and extendible in the holder, a thumbscrew turned on the pivotal axis of the holder pushing an axially movable first plate of the holder against a second plate that is clamped onto the upper end of the second pole; whereby, the upper end of the third pole which is configured for attachment of a microphone can be positioned and locked at various elevations and extensions, both of which are simultaneously locked by rotation of the thumbscrew, the construction providing a folded position of the third pole wherein it is fully retracted and stands parallel to the first and second pole sections, but laterally spaced apart so that it is not in the plane of symmetry of the first and second pole sections. Since the thumbscrew turns on the pivotal axis of the holder, this construction is satisfactory only for carrying a lightweight device such as a microphone and not the much heavier surveillance devices which the instant holder must hold steady.

Krien et al., "Portable Seat and Platform Support", U.S. Pat. No. 6,895,709 B1, issued May 24, 2005, discloses several embodiments of a table-like "platform" that is detachably clamped to the upper end of a post by means of a cap screw that is threaded through a coupling that is provided on an underside surface of the platform. Tripod legs are detachably clamped to a lower end of the post. The post is cylindrical and has a cylindrical collar on it that is slidable up or down on the post and is also rotatable around the post, the post defining a swivel axis. An arm member has an inboard end fixed to the collar so that the arm member projects laterally from the collar. A backless seat is fixed to the outboard end of the arm member. The post is provided with holes which are engaged by a pin that in one embodiment passes through a locking ring that is positioned under the collar whereby the elevation of the collar on the post is set but the seat can still be rotated around the post; and in another embodiment the pin passes through the collar itself whereby the seat cannot be rotated around the post. Since Krien's seat is supported at the end of an arm that projects radially from the post, it constitutes a saddle seat, but it does not swivel in the sense of carrying the post around a swivel axis; it does the reverse: it orbits around the stationary post which defines the swivel axis; the post cannot be swung 360 degrees around Krien's seat. The Krien saddle seat is not foldable.

Vodinh, "Folding Seat Assembly", U.S. Pat. No. 6,224,153 B1, issued May 1, 2001, discloses a backless and foldable saddle seat that is attached to a seat bracket that slides axially of one end of a first arm member that has its opposite end pivotally attached to a first clamp. A second arm member under the first has one end pivotally secured to the seat bracket and has its opposite end pivotally secured to a second clamp. The clamps enable attachment of the seat to one of the two posts that hold up the ends of a tennis net; the result conceived being to provide a seat on which a player can rest when not playing, the seat being raisable to a folded storage position when the game is in progress. In the unfolded position of the seat the first and second arm members form a triangular support for sturdy support of the seat, the seat being foldable upwardly parallel to the post due to the pivotal connections at the ends of the arm members in cooperation with the axial slidability of the seat bracket. Obviously, the net post that is shown in Vodinh's drawings is not a part of the unitary structure that Vodinh discloses; the net post is shown in the drawings merely to illustrate the manner of using the seat assembly. In the present disclosure, the post member is a part of the combination that is claimed, the seat being foldable against the post member. Other differences are that the invention's backless seat is fixed stationary (not axially slidable) on a single support member (not two arms which are hinged together), and the support member is pivotally secured to the main member (not the post member); collectively a much simpler construction that puts the seated person's weight on the main member and not on the post member which has to provide steady support for a surveillance device.

Finally, the prior art includes "tripod heads"—an adaptor that is conventionally fitted to the top of a tripod and provides the means by which a surveillance device such as telescope, spotting scope, binocular, camera, camcorder, etc., is made attachable to the tripod. There are numerous specifically different forms of such adaptors. A herein preferred type is the so-called "ball head", typically having a cylindrical main body portion containing a rigid ball a portion of which is configured to enable a screwed-on attachment of the surveillance device, the cylindrical body portion containing as a clamp that obtains a grip on the ball by manual manipulation of a side-mounted lever whereby the surveillance device can be aimed universally within the range of movability of the ball inside the cylindrical body. FIG. 3 in the accompanying drawings, labeled as prior art, illustrates such a ball head type of tripod head. It is not a claimed element of the invention.

BRIEF SUMMARY OF THE INVENTION

The new and useful result conceived is a skywatcher's tripod comparable to a conventional heavy duty photographer's or surveyor's tripod in weight, compact foldability and hand-carried portability, but inclusive of a swivel seat that enables a seated user to quickly aim a surveillance device 360 degrees compass bearing from ground level to directly overhead in order to quickly acquire and track a moving target; wherein (a) the surveillance device is mounted on the upper end of a single straight elongate extension arm that is axially slidable within a holder that is pivotally secured to the upper end of a post member that forms the forward end of an L-shaped rider support on which the seat is mounted, so that the structure supporting the surveillance device is located wholly IN FRONT OF the seat, thereby affording quick access on and off the tripod as well as unobstructed peripheral vision around the tripod and thereby solving every problem discussed in the Wong patent; wherein:

(b) the rider support, seat and extension arm elements have a common plane of symmetry so that the seated user is provided a logically centered line-of-sight through the surveillance device; and wherein:

(c) compact foldability and hand-carryable portability are provided by a combination of features comprising (1) providing the seat foldable against the post member, (2) providing the post member located so close to the seated user's chest and thereby the swivel axis that foldability of two of the leg members requires centering of the rider support between the said two leg members with the seat in its folded position so that a bottom surface of the seat minimally clears the planes of foldability of the said two leg members, and (3) providing the seat support member inclusive of a handle that when the seat is unfolded depends from the seat support member for storage, but when the seat is folded, a third leg member when in upright folded position substantially abuts the handle and thereby holds the seat in its folded position while simultaneously holding the handle in its unfolded usable position.

The mode of attainment includes prior art structure comprising a base defining a swivel axis, having tripod legs pivotally secured to the base for rotation about axes orthogonal to the swivel axis, the tripod legs having an unfolded position supporting the base at an elevation above a ground surface and having a folded position rising upwardly from the base parallel to the swivel axis, further including spring-biased detent means securing the legs in their alternative folded and unfolded positions. The preamble of Claim 1 appended hereto distinguishes these elements as prior art forming the necessary setting for the portion improved upon.

The improvement provides an L-shaped rider support that comprises an elongate main member that is pivotally secured to the said base for rotation 360 degrees about the swivel axis, and an elongate post member that is secured to a forward end of the main member such that the post member stands preferably perpendicular to the main member, the rider support having a plane of symmetry that extends lengthwise of the main member and includes the post member as well as the swivel axis. An elongate seat support member located on a top side of and extending lengthwise of the main member is likewise centered on the plane of symmetry, the seat support member having a forward end pivotally secured to the main member near the post member for rotation about a seat pivot axis that is perpendicular to the plane of symmetry. A backless seat is secured to a top side of the seat support member centered on the plane of symmetry. The seat support member and the seat mounted on it have a common unfolded position parallel to the main member and are pivotal together about the seat pivot axis to a folded position wherein a top side of the seat stands against a rearward side of the post member. A skywatching tripod must be compact enough that it can conveniently be hand-carried, as it frequently happens that one can park his or her vehicle at one location but must then carry the tripod into a field where there is enough open sky for productive skywatching. The invention tripod achieves such compactness by providing the post member positioned as close as possible to the seated user's chest; i.e., as close to the swivel axis as clearance for using the surveillance device will permit. In the unfolded position of the seat, the seat support member has to be long enough that enough of it is resting on the main member for secure support of the seated user without excessive strain either on the seat support member or on its pivotal connection to the main member, as well as being long enough for support of the seat itself; but at the same time, the seat has to be located far enough forwardly (i.e., close enough to the swivel axis) that the seat in unfolded position is located wholly inboard of an imaginary straight line drawn between the free ends of any two leg members so that the center of gravity of the person sitting on the seat is located close enough to the swivel axis that the possibility of tipping over backwards when the tripod is standing on a gradient is minimized. This result is attained by a combination of features comprising the leg members being made especially long so as to reach further outwardly than is typical of conventional tripods, in combination with the seat pivot axis being located as close as possible to the post member, such that, when the seat is folded, a top surface of the seat is positioned against a rearward side of the post member.

For maximum compactness, the main member has a length as measured from the swivel axis to the post member that is so short that two of the leg members cannot be folded unless (A) the seat is in its folded position with its top surface against the rearward side of the post member, (B) the rider support is centered between the said two leg members so that a rearward end of the main member is thereby aligned with the third one of the leg members, and (C) a bottom surface of the seat only minimally clears the planes of foldability of the said two leg members. Accordingly, a distinguishing characteristic of the present tripod is that two of its leg members are foldable only when the seat is in its folded position and the rider support is centered as described. Unobstructed foldability of the said third leg member is provided by the rearward end of the main member terminating short enough of where the said third leg member is pivotally connected to the base that the said third leg member can be folded upright parallel to the swivel axis.

The mode of attainment includes an extension arm slidably mounted in a holder, the extension arm and holder having a common longitudinal axis. The holder is pivotally secured to the upper end of the post member for rotation about a holder pivot axis that perpendicularly intersects the said plane of symmetry and is located forwardly of a forward side of the post member such that the holder can be pivoted to a position that holds the extension arm parallel and as close as possible to the forward side of the post member, the holder being positioned axially of the holder pivot axis such that the said longitudinal axis lies wholly within the rider support's plane of symmetry.

The extension arm has a fully retracted position in the holder such than an upper end of the extension arm is substantially flush with an upper end of the holder, and the extension arm has a minimal length such that when the extension arm is in its fully retracted and pivotally folded position parallel to the forward side of the post member, a lower end of the extension arm terminates short of the leg members in their unfolded position so that the rider support can always be swiveled 360 degrees without the extension arm abutting any of the leg members even when the extension arm is fully retracted and pivotally folded. The proportions are such that a surveillance device mounted on the extension arm can be sighted on the horizon when the extension arm is in its fully retracted and pivotally folded position.

The upper end of the extension arm is configured for attachment of a tripod head (not a claimed element). Rotation of the holder approximately 45 degrees towards a seated user, combined with full extension of the extension arm having the length specified in paragraphs above and below will locate a tripod head carried by the extension arm at an elevated position overhanging the seated person's head, such that, a surveillance device mounted on the tripod head will be adjustable to a line-of-sight straight through the surveillance device at a target that is located at the zenith.

The height of the post member (i.e., its length) plays a part in determining the length of the extension arm. The extension arm must be short enough not to abut the leg members in their unfolded position as stated in a paragraph above, but must still be long enough that its upper end can locate a surveillance device over the seated person's head under the conditions specified in a paragraph above. Both requirements are met by providing the post member having a length such that, when the extension arm is in its fully retracted and pivotally folded position standing parallel to the forward side of the post member, a surveillance device mounted on a tripod head that is affixed to the upper end of the extension arm is located substantially at the eye level of the seated user; in other words, at an elevation such that said person can sight horizontally straight through the surveillance device at a target that is located on the horizon. It has been found that a post member having such a length enables use of an extension arm that is long enough to enable sighting at the zenith and yet is short enough to be compactly foldable.

The seat support member has a rearward end portion that extends outboard of the base when the seat support member is in its unfolded position parallel to the main member. A handle is fixed to an underside of this rearward end portion of the seat support member, the handle being attached such that when the seat support member is in its unfolded position the handle is in a storage position depending from the seat support member, the rearward end portion of the seat support member extending far enough outboard of the base that the handle hangs spaced above the leg members when the leg members are in their unfolded position so that there is no interference therebetween. The handle has a length such that (a) when the seat is in its folded position standing against the post member, and (b) the rider support is centered between two leg members so that the rearward end of the main member is thereby aligned with the third one of the leg members, and (c) the third leg member is in its folded position standing upright parallel to the swivel axis, a free end of the handle is substantially in abutment with the said third leg member, with the result that the third leg member prevents unfolding of the seat from its upright storage position while at the same time holding the handle in its usable position for carrying the tripod.

Finally, other objects of the present improvement are (a) to provide the elevation of the extended extension arm lockable by a means that takes into account the significant weight of the surveillance device that may be carried, and (b) to provide a swivel lock means that can be applied virtually instantaneously so that the surveillance device can immediately be stopped on a target that suddenly makes its appearance, and which can be applied while the user continues to sight through the surveillance device.

BRIEF DESCRIPTION OF THE SEVERAL VIEWS OF THE DRAWINGS

FIG. 1 shows the ball head holding the scope in a horizontal position aimed at the horizon. Phantom lines indicate that the holder can be rotated rearwardly 45 degrees. A centerline identifies the swivel axis about which the rider support is rotatable.

FIG. 2 shows the seat folded against the post member and the leg members folded upwardly from the base parallel to the swivel axis. FIG. 2 shows the handle abutting one of the leg members whereby the seat is held in its folded position and the handle is held in its usable position.

FIG. 3 is an enlarged front two-quarter perspective general view of the prior art ball head type of tripod head that is shown attached to the extension arm in FIGS. 1, 2, 5, 6, 7 and 8.

FIG. 4 drawn to the same scale as FIG. 3 and is an enlarged broken away side two-quarter perspective view showing how the upper end of the extension arm is preferably configured for attachment of the ball head to the extension arm, with setscrews used for securing the ball head shown in exploded relationship relative to the screw-threaded holes in which the setscrews are received.

FIG. 5 is drawn to the same scale as FIG. 1 and is a similar side elevational general view showing the tripod in a second in-use position wherein the holder has been pivoted rearwardly a few degrees and the extension arm has been partially extended to elevate the scope for aiming it skyward.

FIG. 7 provides a top view of the seat in its unfolded position. FIG. 7 also provides a top view of the base with the tripod leg members in their unfolded position, a rearwardly positioned leg member being shown in full length and the other two forwardly positioned leg members having their outer portions broken away in order to fit the view on the sheet. FIG. 7 shows the rider support centered between the two forwardly positioned leg members so that it is aligned with the third one (rearwardly positioned) of the leg members.

In FIG. 8 the three leg members are seen endwise because folded. As in FIG. 7, FIG. 8 shows the rider support centered between the two forwardly positioned leg members. FIG. 8 shows that when rider support is centered as stated and the seat in its folded position standing against the post member, a bottom surface of the seat only minimally clears the planes of movability of the leg members. Dashed lines indicate the previously unfolded position of the leg members in which they are shown in FIG. 7. In FIG. 8 heavy lines superimposed on the forwardly positioned leg members identify their planes of movability.

FIG. 9 provides a close view of the extension arm holder, showing it to be pivotally locked by a thumbscrew which is shown in exploded relationship relative to the lug member in which the thumbscrew is received. FIG. 9 shows the rider support as seen from its right-hand side and from its rearward end (FIGS. 1, 2, 5 and 6 showing it from its left side). This right-hand view reveals a swivel lock means comprising an elongate steel rod that is manipulated by the seated user to jam the rod against a planar top surface of the base.

FIG. 10 shows the seat located wholly inboard of an imaginary straight line (represented by a phantom line) that has been drawn between the free ends of the said two leg members.

DETAILED DESCRIPTION OF THE INVENTION

Figure 1:
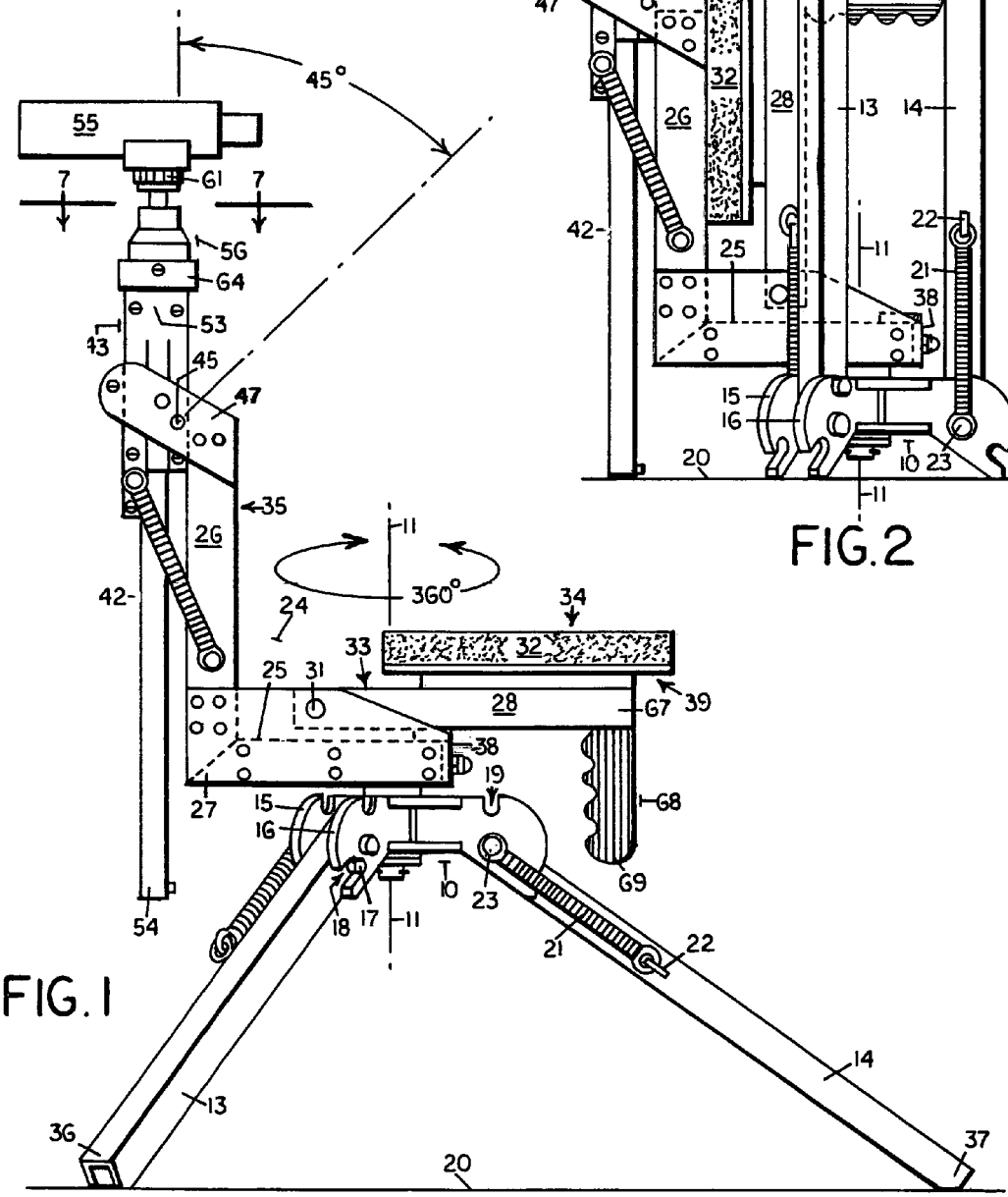
FIG. 1 is a side elevational general view of the invention skywatcher's tripod in a first in-use position with the tripod leg members and the seat in their respective unfolded positions, the extension arm fully retracted and the extension arm holder in its pivotally folded position holding the extension arm parallel to the forward side of the post member, and with a handle for carrying the tripod in a storage position depending from the seat support member. The user has provided a ball head type of tripod head and it is shown in side view attached to the upper end of the extension arm, and the user has also provided a surveillance device, in this instance a spotting scope, represented schematically, attached to the ball head.
Figure 2:
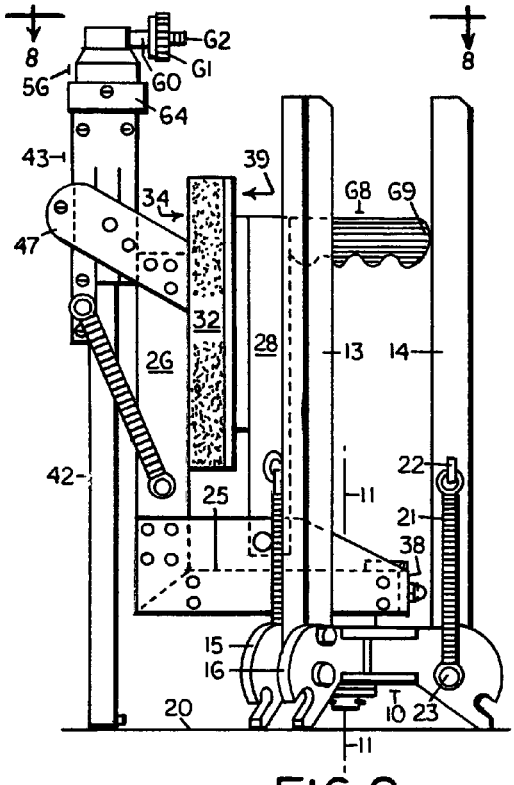
FIG. 2 is drawn to the same scale as FIG. 1 and is a similar side elevational general view but showing the tripod in its fully folded configuration with the scope having been removed from the ball head and the ball element rotated downward for its protection and to minimize overall height.
Figure 8:
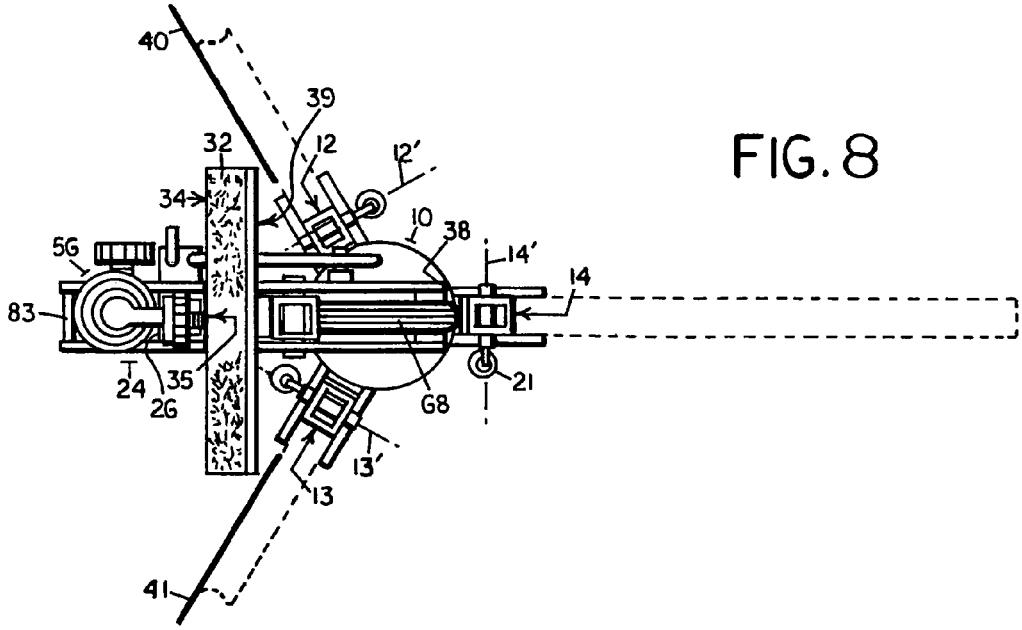
FIG. 8 is a is top elevational general view of the tripod similar to and drawn to the same scale as FIG. 7 and taken on the line 8-8 of FIG. 2, FIG. 7 providing a top view of the seat folded against the post member.
Figure 10:
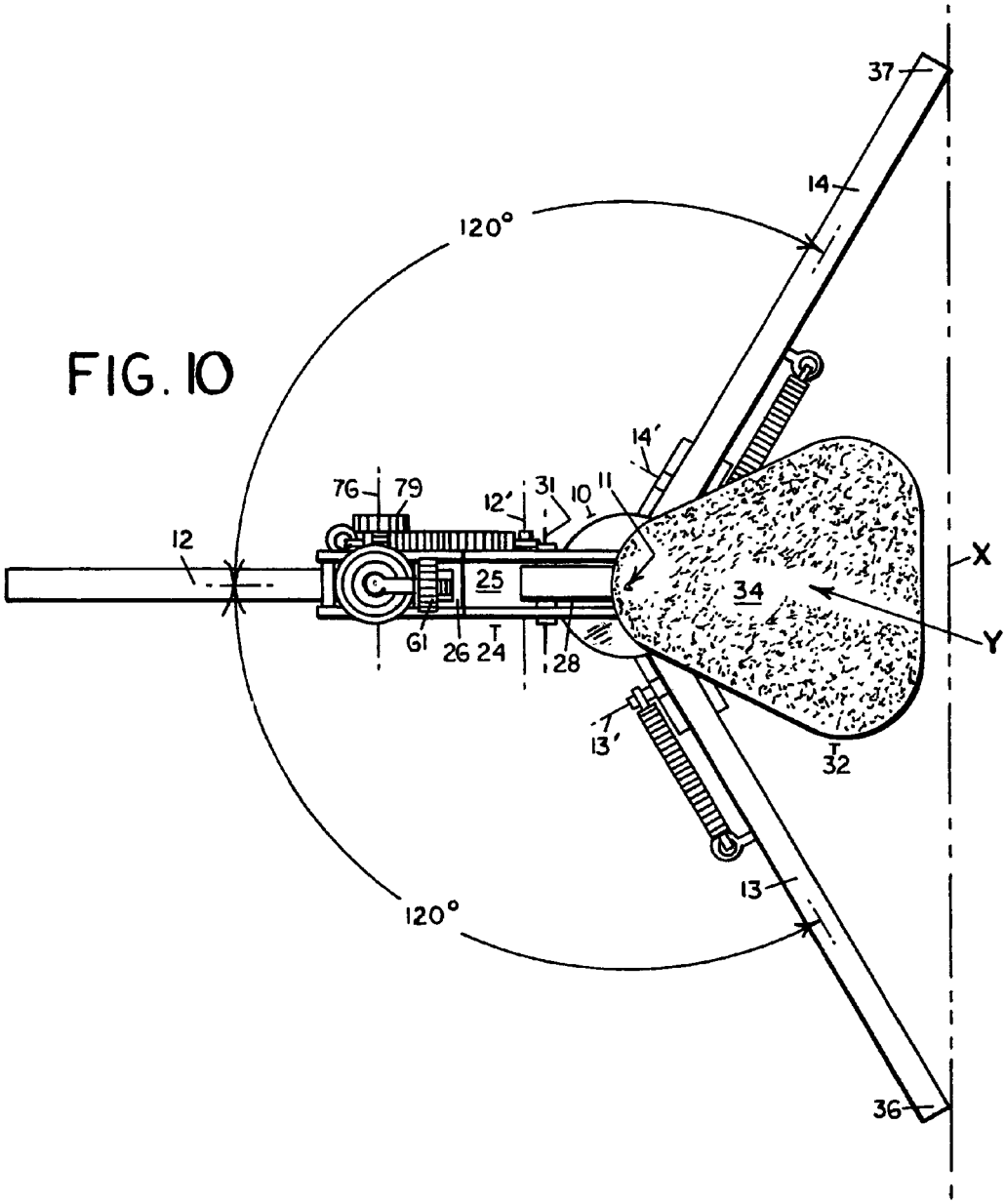
FIG. 10 is a top elevational general view of the tripod similar to and drawn to the same scale as FIG. 7 but showing all three of the leg members in full length and showing the rider support swiveled 60 degrees (relative to the position in which it is shown in FIG. 7) so that in FIG. 10 the seat is positioned centered between two of the leg members.

Referring to the accompanying drawings, a skywatcher's tripod according to the present improvement includes prior art comprising a base, indicated generally as 10, FIGS. 1 and 10, defining a swivel axis 11, three leg members 12, 13, 14, FIG. 10, pivotally secured to the base 10 for rotation about leg pivot axes 12', 13', 14', respectively, FIGS. 8 and 10, which are orthogonal to the swivel axis 11, the base 10 including three pairs of parallel spaced apart base lugs as at 15, 16, in FIGS. 1 and 2, between which the leg members, such as leg member 13 in FIG. 1, are secured. Each leg member includes a pin as at 17, FIG. 1, that is received in notches as at 18 (associated with leg member 13) and 19 (associated with leg member 14), which are formed in each pair of base lugs, whereby the leg members are securable in an unfolded position as shown in FIG. 1 wherein the leg members are positioned inclined downwardly from the base 10 in order to support the base 10 at an elevation spaced above a ground surface 20 on which the tripod stands, and alternatively, are securable in a folded position as shown in FIG. 2 wherein the leg members are seen standing upright encircling the base 10 parallel to the swivel axis 11. Each leg member has a spring as at 21, FIGS. 1 and 2, that is connected at one end as at 22 to the leg member and is connected at its opposite end as at 23 to the base 10 whereby the leg member is biased to engage one or the other of the detent notches.

Figure 9:
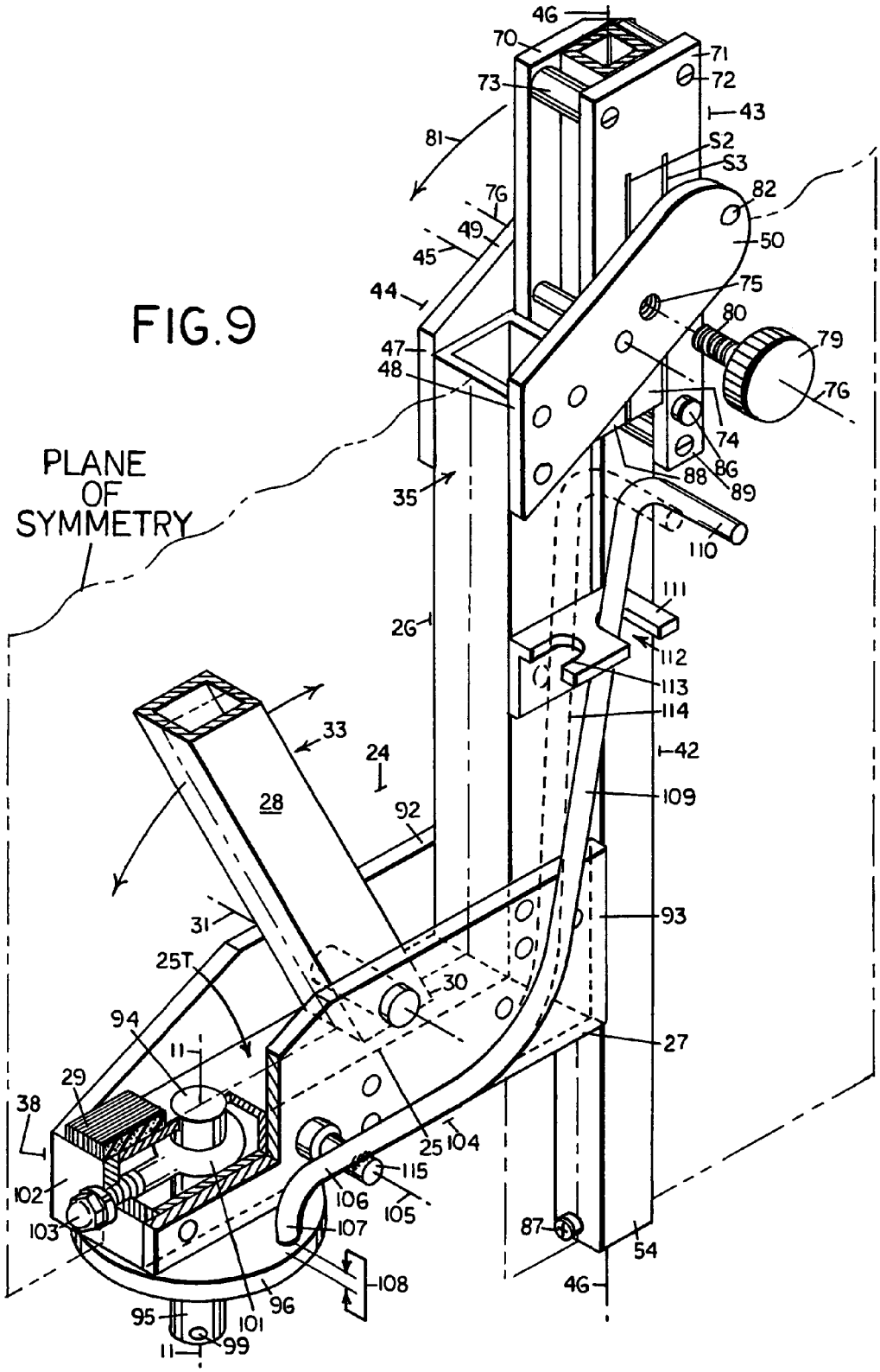
FIG. 9 is a greatly enlarged detail view in three-quarter perspective of the rider support mounted on a broken away top portion of the base, the rider support including the holder with the extension arm mounted in the holder, the upper end of the extension arm being sectioned away, showing a section only of the seat support member pivotally secured to the rider support.

The claimed improvement pertains in part to the provision of a rider support, indicated generally as 24, FIGS. 1 and 9, comprising an elongate main member 25, FIGS. 1 and 9, that is pivotally secured to the base 10, FIG. 1, for rotation 360 degrees about the swivel axis 11; further comprising a post member, indicated generally as 26, FIGS. 1 and 9, that is secured to a forward end 27 of the rider support 24 such that the post member 26 stands perpendicular to the main member 25, the rider support 24 having a plane of symmetry, labeled as such in FIG. 9 and drawn in phantom outline having a broken away top border, the plane of symmetry extending lengthwise of the main member 25 and including the post member 26 and the swivel axis 11; further comprising an elongate seat support member, indicated generally as 28, FIGS. 1 and 9, that is located on a top side 25T, FIG. 9, of the main member 25, the seat support member 28 extending lengthwise of the main member 25 and being likewise centered on the plane of symmetry (FIG. 9), the seat support member 28 having a forward end 30, FIG. 9, that is pivotally secured to the main member 25 near the post member 26 for rotation about a seat pivot axis 31, FIGS. 1, 9 and 10, that is perpendicular to the said plane of symmetry; further comprising a backless seat, indicated generally as 32 in FIGS. 1, 2, 5, 6, 7, 8 and 10, secured to a top side 33, FIGS. 1, 5, 6 and 9, of the seat support member 28 and likewise centered on the said plane of symmetry, the seat support member 28 and the seat 32 mounted on it having a common unfolded horizontal position as shown in FIG. 1 wherein they are parallel to the main member 25, and being pivotal upwardly together about the seat pivot axis 31, FIGS. 1 and 9, to a folded position as shown in FIGS. 2 and 8, standing upright parallel to the swivel axis 11 (FIGS. 1 and 2) with a top surface 34, FIGS. 1, 2 and 8, of the seat 32 against a rearward side 35, FIGS. 1 and 9, of the post member 26, the seat 32 being positioned lengthwise of the seat support member 28 such that in the unfolded position of the seat 32, the seat 32 is located wholly inboard of an imaginary straight line X, FIG. 10, drawn between the free ends (such as 36, 37, FIG. 10) of any two of the leg members (such as 13, 14, FIG. 10, respectively) when in their unfolded position standing on a ground surface 20, FIG. 1, whereby the center of gravity Y of a person sitting on the seat 32 is close enough to the swivel axis 11, FIG. 10, that there is little likelihood of the seated person falling over backwards when the tripod is situated on a gradient.

Figure 7:
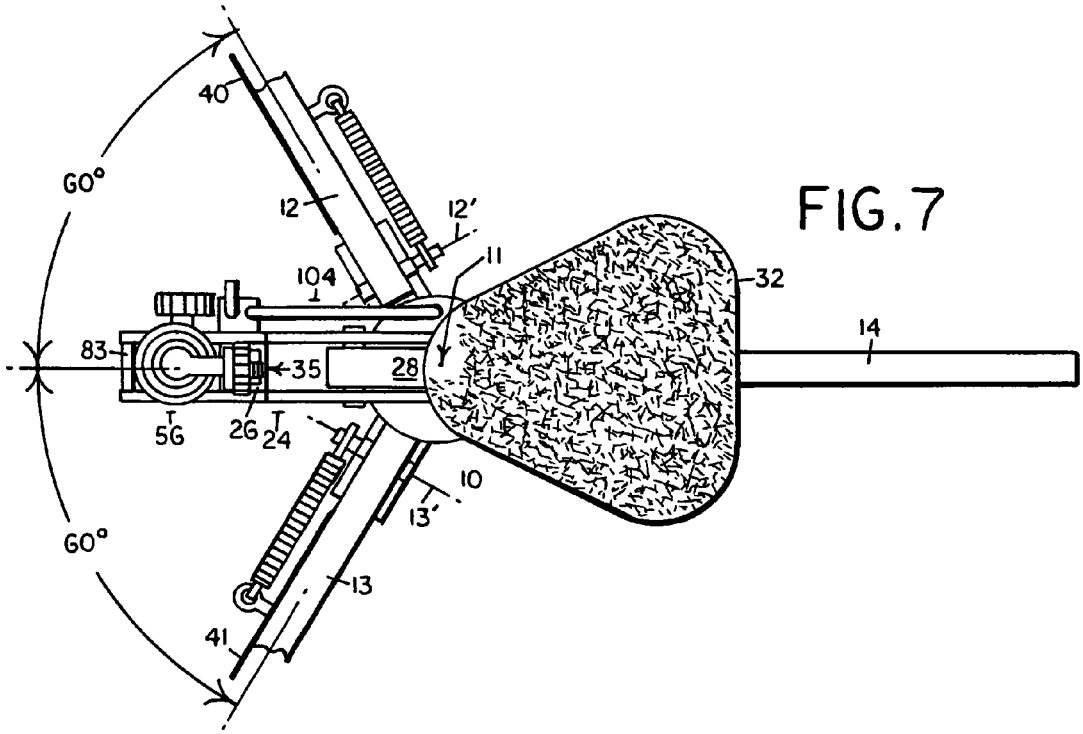
FIG. 7 is a top elevational general view of the tripod drawn to the same scale as FIG. 1 and taken on the line 7-7 of FIG. 1, showing the extension arm and its holder in the same position as it is shown in FIG. 1 but without the scope attached to the ball head and with the ball element of the ball head rotated into the horizontal position in which it is shown in FIG. 2.

Folded compactness comparable to a conventional heavy duty photographer's or surveyor's tripod is attained by providing the main member 25, FIG. 2, having a length as measured from the swivel axis 11 to the post member 26 such that (A) when the seat 32, FIG. 2, is in its folded position with its top side 34 against the rearward side 35, FIG. 1, of the post member 26 as shown in FIGS. 2 and 8, and (B) the rider support 24 is centered between any two of the leg members (such as 12, 13 in FIGS. 7 and 8) so that a rearward end 38, FIGS. 1, 2, 8 and 9, of the rider support 24 is thereby aligned with the third one of the leg members (such as 14 in FIGS. 2 and 8), a bottom surface 39, FIG. 8, of the seat 32 only minimally clears the planes of foldability 40, 41, FIGS. 7 and 8, of the said two leg members 12, 13, respectively, so that, assuming the seat 32 has a comfortable width such as 30.48 cm (12 inches), the said two leg members (12, 13) are foldable only when the seat 32 is in its folded position with the rider support 24 centered as described.

The rider support 24 further includes an extension arm, indicated generally as 42, FIGS. 1, 2, 5, 6 and 9, slidably mounted in a holder, indicated generally as 43, that is pivotally secured to the upper end, indicated generally as 44, FIG. 9, of the post member 26 for rotation about a holder pivot axis 45, FIG. 9, that perpendicularly intersects the rider support's plane of symmetry, the extension arm 42 and its holder 43 having a common longitudinal axis 46, FIG. 9, that is located in said plane of symmetry. The plane of symmetry, FIG. 9, is drawn in phantom line outline, and the broken line top border indicates that the plane of symmetry actually continues upwardly so as to encompass the holder 43, FIG. 9, as well as the extension arm 42 at every position of its extension and rotation.

A pair of lug members 47, 48, FIG. 9, form the upper end of the post member 26, the lug members 47, 48, having corresponding free end portions 49, 50, respectively, that extend further forwardly of the forward side 51, FIG. 5, of the post member 26, FIG. 9, spaced apart parallel to and equidistant from opposite sides of the plane of symmetry, and the holder 43 is pivotally secured between the free end portions 49, 50, of the lug members 47, 48, respectively, such that the holder 43 can be rotated to a folded position as shown in FIGS. 1, 2 and 9, that holds the extension arm 42 parallel to the forward side 51, FIG. 5, of the post member 26 and as close as possible to it as shown in FIGS. 1, 2 and 9.

As shown in FIGS. 1 and 2, the extension arm 42 has a fully retracted position in the holder 43 such that an upper end 52, FIG. 5, of the extension arm 42 is substantially flush with an upper end 53 of the holder 43, as shown in FIG. 1, and the extension arm 42 has a length such that, when the extension arm 42 is fully retracted and is positioned parallel to the forward side 51, FIG. 5, of the post member 26 and the leg members are in their unfolded position as shown in FIG. 1, the lower end 54, FIG. 1, of the extension arm 42 terminates short of the leg members so that the rider support 24 can be swiveled 360 degrees without the extension arm 42 abutting any of the leg members even when the extension arm 42 is in the fully retracted and pivotally folded position in which it is shown in FIG. 1.

For most rigid (stationary) support of a surveillance device, the extension arm 42 must be as short as possible in order to minimize unintended flexure that is inherent in the material from which the extension arm 42 is constructed, which, in this embodiment, is a cross-sectionally square aluminum tube (tubing being used for lightness of weight and aluminum being preferred for the same reason). The length of the extension arm 42 is minimized by proportioning the post member 26 such that, when the extension arm 42 is in its fully retracted and pivotally folded position as shown in FIG. 1, a straight line-of-sight surveillance device, such as a binocular or the scope 55 seen in FIG. 1, is held at the eye level of a person seated on the seat 32 so that such person can sight straight through the device at a target that is located on the horizon.

The upper end 52, FIG. 5, of the extension arm 42 is configured for attachment thereon of a tripod head. A ball head type of tripod head is preferred because it enables universal aiming of the surveillance device within the range of movability of the ball element that is incorporated in the ball head. A typical conventional configuration of such a ball head tripod head is shown in FIG. 3, indicated generally as 56 in FIG. 3 and also in FIGS. 1, 2, and 5 through 8. It comprises a typically cylindrical housing 57, FIG. 3, containing a ball 58 onto which the housing 57 effectively obtains a clamped grip by manipulation of a lever 59. The ball 58 is formed inclusive of a short post 60 that has an upper end defining a face plate 61 that is provided with a screw end 62 that is fixed to the faceplate 61 and which, by rotation of the faceplate 61 (after first loosening the ball 58 by manipulation of the lever 59), can be turned into a correspondingly screw-threaded opening (not shown) that is conventionally provided in the underside of surveillance devices which are designed for attachment to a tripod. A slight turn of the lever 59 in one direction loosens the grip of the housing 57 on the ball 58 whereby the angular position of the surveillance device on the ball head 56 is adjustable; turning the lever 59 in the opposite direction locks the ball 58. Conventionally the housing 57 is provided with a notch 63 (some ball heads provide two notches located on opposite sides of the housing 57) into which the short post 60 can be lowered in order to thereby maximize the angular adjustability of the surveillance device relative to the housing 57. FIG. 2 shows the short post 60 of the ball head 56 in a position lowered into the notch 63, FIG. 3, so that the faceplate 61 which is shown upright in FIG. 1, is, in FIG. 2 shown lowered into a storage position that better protects the screw end 62, FIGS. 2 and 3, and at the same time minimizes the folded height of the tripod.

Referring to FIG. 4 which shows a broken away upper end portion of the extension arm 42, the upper end 52 of the extension arm 42 is configured for attachment of a tripod head, in this instance, the ball head 56 that is shown in FIG. 3. Conventionally, the housing 57 of the ball head 56 is provided having its underside (not shown) provided with a screw-threaded opening and the conventional tripod is provided having its upper end incorporating a screw-end identical to element 62 of FIG. 3, whereby the housing 57 of the ball head 56 obtains a screwed on attachment to the upper end of the conventional tripod. A problem has been found in that, in the course of aiming an attached heavy surveillance device (such as a spotting scope or binocular) in different directions, there is a tendency for the ball head's housing 57 to become unscrewed. In the present embodiment, this possibility is precluded by not using the conventional screwed-on method of attachment but instead having a lower end margin of the ball head's housing 57 received in a cup 64, FIG. 4, that is fixed (e.g., by welding) to the upper end 52 of the extension arm 42, and providing the cup 64 with a plurality of screw-threaded holes, such as at 65, into which setscrews, such as at 66, are turned and jammed against the housing 57 of the ball head 56. See also FIG. 5 showing the cup 64 fixed to the upper end 52 of the extension arm 42, with the ball head 56 partially received inside and rigidly fastened to the cup 64 by a setscrew 66.

The seat support member 28, FIG. 1, has a rearward end portion 67 that extends outboard of the base 10 when the seat 32 is in the unfolded position in which it is shown in FIG. 1. A handle, indicated generally as 68, is provided fixed to the rearward end portion 67 so as to depend from same when the seat 32 is in its unfolded position; the handle 68 being at such time in a storage position. The outboard projection of the rearward end portion 67 and the length of the handle 68 are such that (a) there is enough clearance between the free end 69 of the handle 68 and the leg members that the rider support can be swiveled 360 degrees about the swivel axis 11 without the handle 68 striking any of the leg members, and (b) such that, when the seat 32 is in its folded position as shown in FIG. 2 with the rearward end 38 of the rider support 24 aligned with a folded one of the leg members (such as leg member 14 in FIG. 2), the free end 69, FIG. 2, of the handle 68 is proximate the folded leg member as shown in FIG. 2, with the result that the substantially abutting leg member (such as 14 in FIG. 2) prevents unfolding of the seat 32 while simultaneously keeping the handle 68 in the horizontally disposed ready-for-use position in which it is shown in FIG. 2.

Returning to FIG. 9, in this embodiment the holder 43 comprises two elongate planar parallel spaced apart side members 70, 71, which are rigidly fastened together by screws or rivets a visible end of one of which is indicated at 72, each of which screws or rivets passes through a spacer, one of which is indicated at 73, the spacers being located along lengthwise margins of the side members 70, 71, and being spaced apart from each other as necessary for close support of the four sides of the extension arm 42 with operating clearance therebetween to permit the extension arm 42 to be moved axially of the longitudinal axis 46 within the holder 43 (the uppermost corner of holder 43 is broken away to fit the view on the sheet). The side members 70, 71, are identical, so what is next described in connection with side member 71 applies as well to side member 70.

Side member 71, FIG. 9, is provided with a pair of parallel spaced apart slits S2, S3, which creates a segment 74 of side member 71 that is depressible against the adjacent side of the extension arm 42. The end portion 50 of lug member 48 is provided with a screw-threaded hole 75 that is RADIALLY REMOVED FROM the pivotal axis 45 of the holder 43; i.e., the screw-threaded hole 75 has a hole-center axis 76 that is parallel to and is SPACED APART FROM the holder's pivotal axis 45. The hole-center axis 76 intersects the depressible segment 74 of side member 71, FIG. 9, and likewise intersects a corresponding depressible segment 77 of side member 70, FIG. 6; lug member 47, FIG. 6, being provided with a screw-threaded hole 78 that corresponds with screw-threaded hole 75 and is likewise formed concentric about hole-center axis 76, FIG. 9.

A thumbscrew, indicated generally as 79 and shown in exploded relationship in FIG. 9, has a screw-threaded end 80 that is turned into the hole 75 so as depress the segment 74 against the extension arm 42 and thereby simultaneously lock pivotal movability of the holder 43 and axial movability of the extension arm 42. FIG. 9 shows the holder 43 in its pivotally folded position wherein it is positioned parallel to the post member 26. In this folded position of the holder 43, the screw-threaded end 80 of the thumbscrew 79 strikes the depressible segment 74 of the holder 43 at a point thereon that is very close to slit S2. The holder 43 is rotatable 45 degrees in the direction indicated by arcuate arrow 81. When the holder 43 is at its maximum 45 degree rotated position, the screw-threaded end 80 of the thumbscrew 79 strikes the depressible segment 74 of the holder 43 at a point thereon that is very close to slit S3. At all rotated positions of the holder 43 between fully folded position as shown in FIG. 9 to fully rotated 45 degrees position as shown in FIG. 6, the screw-threaded end 80 of the thumbscrew 79 always performs its clamping action within the width of the depressible segment 74 and never touches either of the adjoining rigidly secured margins of the side member 71.

Figure 6:
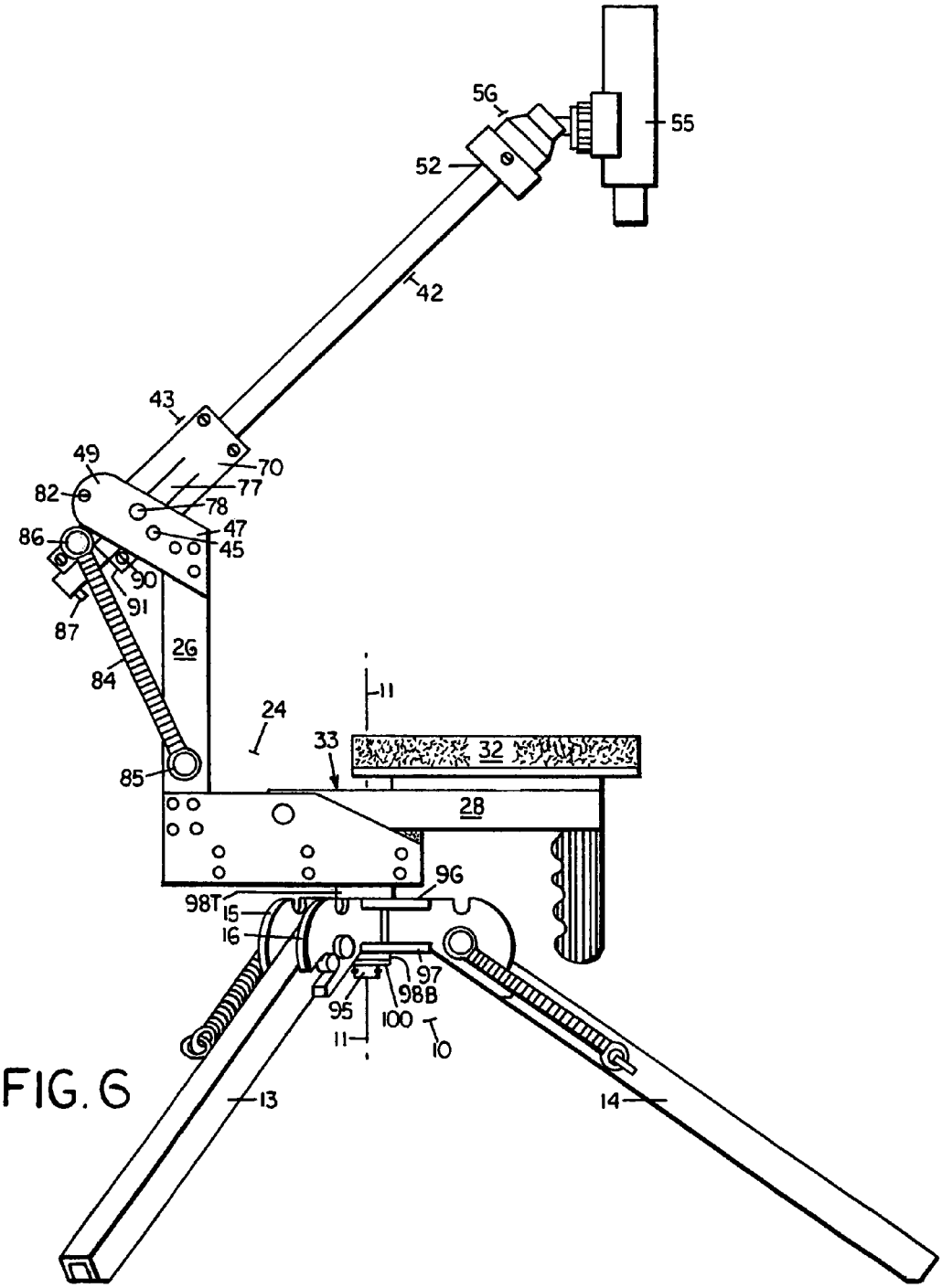
FIG. 6 is drawn to the same scale as FIG. 5 and is a similar side elevational general view showing the tripod in a third in-use position wherein the holder has been pivoted rearwardly a full 45 degrees and the extension arm has been fully extended in order to aim the scope at a target that is located directly overhead.

For practical usefulness of the invention skywatcher's tripod, the extension arm 42, even when extended as shown in FIG. 6, has to be able to positively lock the elevation of a surveillance device having a significant weight, at least 2.27 Kg (5 Lbs.). Since this weight is carried at the end of an extended arm, it obtains a considerable leverage at the holder's pivotal point 45, FIGS. 6 and 9. Location of the thumbscrew's axis 76, FIG. 9, radially spaced apart from the holder's pivot axis 45, enables the thumbscrew 79 to obtain a better grip on the holder 43 than would be the case if the thumbscrew turned on the holder's pivot axis 45. The illustrated configuration of the holder 43 such that its depressible segment 74 is spaced apart from the holder's pivot axis 45 is what makes it possible to locate the thumbscrew's axis 76 radially removed from the holder's pivot axis 45.

The location of the holder 43 mounted between two parallel spaced apart lug members 47, 48, makes it possible to use two thumbscrews aligned on the same axis 76 but in opposed relationship to each other so as to clamp the holder 43 between them, with the result that the strongest possible clamping action is obtained on the holder 43, strong enough to positively prevent a carried elevated surveillance device from gradually slipping downwardly to an undesired lower elevation. As mentioned at the end of a paragraph above, FIG. 6 shows a second screw-threaded hole 78 into which a second thumbscrew (not shown) may be turned. Spreading apart of one or both lug end portions 49, 50, FIG. 9, is prevented by provision of a screw or rivet 82 that fastens the end portions 49, 50, together; the fastener passing through a spacer 83, FIGS. 7 and 8, that is positioned between the end portions 49, 50, the spacer 83 having a length that ensures the proper spaced apart relationship between the end portions 49, 50.

An extension spring 84, FIG. 6, has a lower end secured to a first shaft 85 that projects laterally from a side of the post member 26, and has an upper end secured to a second shaft 86, FIGS. 6 and 9, that projects laterally from a lower end of the holder 43; the spring 84, FIG. 6, being connected in initial tension so as to counterbalance the weight of the extension arm 42 and at least some of the weight of any of the various surveillance devices that are likely to be carried by the extension arm 42.

A boss 87, FIG. 9, located near the lower end 54 of the extension arm 42 is formed by a screw passed through a spacer. The boss 87 prevents unintended complete withdrawal of the extension arm 42 by impacting the first-encountered one of the spacers which are located between the side members 70, 71, of the holder 43. The rigidly secured margin 88, FIG. 9, of the holder 43 is made shorter in length than the likewise rigidly secured margin 89 in order to allow the extension arm 42 to be extended further before the boss 87 impacts the spacer/fastener indicated by the numeral 90 in FIG. 6 that is securing the lower end of margin 88, FIG. 9, to the lower end of margin 91, FIG. 6.

As stated at the outset, the present disclosure is a Continuation-in-Part of an original application Ser. No. 11/483,363, filed Jul. 21, 2006. In that original disclosure, the tripod's post member is provided having its lower end pivotally secured so that the post member is adjustable to a forwardly leaning position as well as being positionable parallel to the swivel axis. This adjustability was provided in order to provide a seated user of the tripod with additional clearance between himself and the post member. Since that original filing date, field experience using prototypes has shown that such additional clearance is not critical; a more important consideration is maximum rigidity. Every movable joint in the construction creates a potential for shakiness, and so in the currently preferred embodiment the post member 26, FIG. 9, is rigidly fixed (preferably in perpendicular relationship for most compactness) to the main member 25 by means of first and second side plates 92, 93, respectively, which, in this embodiment, are riveted to the post member 26 and to the main member 25; the side plates 92, 93, also enhancing the rigidity of the main member 25 which, like the post member 26, is made of square aluminum tubing. A cross-sectionally round steel shaft, indicated generally as 94, FIG. 9, concentric about the swivel axis 11 passes vertically through the main member 25 so that a lower end portion 95 of the shaft 94 depends from the main member 25. In FIG. 9, the numeral 96 indicates only a circular top plate portion of the base which is indicted generally as 10 in FIG. 6; the base 10, FIG. 6, having a corresponding bottom plate 97. The three pairs of parallel spaced apart lugs, such as the lugs 15, 16, in FIG. 6, between which the leg members such as leg member 13 are pivotally secured, are located between and are welded or bolted to the top and bottom plates 96, 97, FIG. 6. FIG. 9 shows only the top plate 96 in order to fit the view on the sheet. It is to be understood that the lower portion 95, FIG. 9, of the steel shaft 94 is journaled in a first flanged bronze bearing 98T, FIG. 6, that is press-fitted into an opening that is provided in the top plate 96 with the bore of the bearing concentric about the swivel axis 11, and that the bottom plate 97, FIG. 6, is likewise provided with a second flanged bronze bearing 98B but inverted so that the flange of bearing 98B is positioned lowermost. The lower end portion 95, FIG. 9, of the steel shaft 94 is pivotally secured to the base 10, FIG. 6, by means of a cotter pin (not shown) that is passed through a hole 99, FIG. 9, that is drilled through the lowermost end of the steel shaft 94, with a washer 100, FIG. 6, placed between the coffer pin and the flange of the lower bearing 98B. The rider support structure 24 shown in FIG. 9 is thereby understood to be positively secured to the base 10 which, in FIG. 9, is represented only by the circular top plate 96 portion of the base 10. The partially sectioned away rearward end 38, FIG. 9, of the rider support 24 reveals that the steel shaft 94 is fixed to the aluminum main member 25 by passage through an eyebolt 101, FIG. 9, the screw-threaded end of which passes through a back plate 102 to which the eyebolt 101 is secured by means of a cap nut 103. The rubber pad 29 serves to cushion the unfolded seat support member 28.

The structure shown in FIG. 9 includes a swivel lock that enables the user to almost instantly lock or release rotation of the rider support 24 about the swivel axis 11; it is a significant improvement over the swivel lock shown in the original disclosure which requires many turns of an elongate screw to jam it against the base on which the rider support swivels. As described above in a paragraph above, folding of the tripod disclosed herein requires a prerequisite particular alignment of the rider support 24 relative to the leg members, 12, 13, 14, such that the forward end of the rider support 24 is centered between two of the leg members as shown in FIGS. 7 and 8 so that the rearward end 38, FIG. 8, of the rider support 24 is aligned with the third one of the leg members. This alignment can suddenly change if the rider support 24 is free to swivel during the time the leg members are being lifted from their unfolded position to their folded position. To prevent loss of the desired alignment it is helpful to include a swivel lock, preferably one that is easy to engage and disengage in order that it will not become an annoying chore. Ease of use is also an advantage during skywatching when one wishes to instantly lock the rider support at a particular compass bearing, and it is advantageous to be able to do so while continuing to sight through the surveillance device in order not to lose the target.

The fixed attachment of the post member 26, FIG. 9, to the main member 25, enables provision of an instantly engageable and disengageable swivel lock comprising an elongate steel rod, indicated generally as 104, FIG. 9, that is stiff but is capable of some degree of flexure. The steel rod 104 is pivotally secured to a lateral side of the main member section 25 of the rider support 24 for rotation about a rod pivot axis 105 that perpendicularly intersects the plane of symmetry near the swivel axis 11, between same and the post member 26. The steel rod's pivot axis 105 demarcates (A) a short rearward segment 106 of the rod 104 that extends from the rod's pivot axis 105 to a rearward terminal 107 of the rod 104 that is configured for depression against the top plate 96 of the base 10 and in the disengaged configuration of the rod 104 is positioned minimally spaced apart from the top plate 96 as is indicated in FIG. 9 by the clearance indicated at 108, and (B) a much longer forward segment 109 of the rod 104 that has a forward terminal 110 that is graspable by a seated user to enable pulling or pushing the forward segment 109 so as to pivot the rod 104 about the rod pivot axis 105. A rod holding bracket 111 fixed to and extending laterally from the adjacent side of the post member 26 is provided with a first detent notch 112 that holds the forward segment 109 of the rod 104 in a forward position as shown in FIG. 9 whereby the clearance 108 is maintained, and the rod holding bracket is provided with a second detent notch 113 that holds the forward segment 109 of the rod 104 in a rearwardly pulled position that lowers the rearward terminal 107 into frictional contact with the top plate 96 and simultaneously forces a flexure of the forward segment 109 so that the rearward terminal is jammed against the top plate 96 with a force that is great enough to stop rotation of the rider support 24 about the swivel axis 11. The dashed lines 114 indicate this rearwardly moved alternative position of the forward segment 109 of the rod 104 which cannot be attained except by flexure of the forward segment 109, whereby the resistance to flexure that is inherent in the steel rod holds the rearward terminal 107 forcibly jammed against the top plate 96 of the base 10. Finally, the rod 104 is welded to a shaft 115, FIG. 9, that passes through the main member 25 and is pivotally secured thereto so that the shaft 115 defines the rod pivot axis 105. The welded attachment of the rod 104 to the shaft 115 prevents lateral movement of the forward terminal 110 away from the post member 26 except by lateral flexure of the forward segment 109 so that the forward segment is always biased toward the post member 26 and therefore when the forward segment 109 is moved out of engagement with one notch, it is always biased to seek engagement with the other notch.

I claim:

1. A compactly foldable skywatcher's tripod including a base defining a swivel axis, three leg members pivotally secured to said base at a common radius from said swivel axis for rotation about leg pivot axes orthogonal to said swivel axis, said leg members being spaced apart equidistant from each other, each of said leg members having a free end configured for stationary placement on a ground surface, each of said leg members having a folded position standing upright parallel to said swivel axis encircling said base and an alternative unfolded position supporting said base at an elevation spaced above said ground surface, each of said leg members being provided with a means for holding the leg member in its folded and unfolded positions;

wherein the improvement comprises:

an L-shaped rider support comprising an elongate main member and an elongate post member secured to a forward end of said main member, said main member being pivotally secured to said base for rotation 360 degrees about said swivel axis, said rider support having a plane of symmetry that extends lengthwise of said main member and includes said post member and said swivel axis;

an elongate seat support member positioned on a top side of and extending lengthwise of said main member and likewise centered on said plane of symmetry, said seat support member having a forward end pivotally secured to said main member near said post member for rotation about a seat pivot axis perpendicular to said plane of symmetry;

a seat secured to a top side of said seat support member centered on said plane of symmetry, said seat support member and said seat having an unfolded position parallel to said main member and being pivotal together about said seat pivot axis to an upright folded position wherein a top surface of said seat is positioned against a rearward side of said post member;

said leg members having a length such that in said unfolded position of said seat and said leg members, said seat is located wholly inboard of an imaginary straight line drawn between the free ends of any two of said leg members;

said main member having a length as measured from said swivel axis to said post member such that (A) when said seat is in said folded position against said post member and (B) said post member is centered between two of said leg members so that a rearward end of said main member is thereby aligned with the third one of said leg members, a bottom surface of said seat minimally clears the nearest planes of foldability of said two leg members so that when said two leg members are standing upright in their folded position said seat when in folded position is located immediately outboard of said folded two leg members;

said rearward end of said main member terminating short of the folded position of said third leg member;

said post member having an upper end defining lug means extending forwardly of a forward side of said post member opposite from said rearward side of said post member, a single straight elongate extension arm slidably mounted in a holder, said extension arm and said holder having a common longitudinal axis located in said plane of symmetry, said holder being pivotally secured to said lug means for rotation about a holder pivot axis perpendicularly intersecting said plane of symmetry, said holder pivot axis being spaced apart from said forward side of said post member such that said holder is rotatable to a position holding said extension arm in a pivotally folded position parallel to said forward side of said post member;

said extension arm having a fully retracted position in said holder and said extension arm having a length such that when said extension arm is in said fully retracted and pivotally folded position parallel to said forward side of said post member, a lower end of said extension arm terminates short of said leg members in their unfolded position;

said upper end of said extension arm being configured to secure a tripod head adapted to hold a surveillance device;

said post member having a length such that when said extension arm is in said fully retracted and pivotally folded position, a surveillance device carried on a tripod head that is secured to said upper end of said extension arm is located substantially at the eye level of a person when seated on said seat, such that, said person has a straight line of sight through said surveillance device at the horizon;

an upper end of said holder being rotatable toward said seat and said extension arm being axially extendible to a position holding said carried surveillance device overhanging a seated user's head.

2. A compactly foldable skywatcher's tripod as recited in claim 1, further comprising:

said seat support member having a rearward end portion that extends outboard of said base when said seat support member is in said unfolded position parallel to said main member;

a handle fixed to said rearward end portion of said seat support member so as to depend from same when said seat support member is in said unfolded position, said rearward end portion of said seat support member extending far enough outboard of said base that clearance is provided between a free end of said handle and said leg members when said leg members are in their unfolded position;

said handle having a length such that (a) when said seat is in said folded position against said post member and (b) said rider support is centered between two of said leg members such that said rearward end of said main member is aligned with the third one of said leg members and (c) said third leg member is in its folded position standing upright parallel to said swivel axis, said free end of said handle is close enough to said third leg member that said third leg member prevents unfolding of said seat while at the same time keeping said handle in its unfolded position for carrying said tripod.

3. A compactly foldable skywatcher's tripod as recited in claim 1, further comprising:

said extension arm being straight and being square in cross-section so that its four sides each have the same given width, the said given width of each of said sides being for reference purposes herein designated the width of said extension arm and said width being uniform over the full length of said extension arm;

for reference purposes herein, first two sides of said extension arm opposite from each other being designated side surfaces and the other two sides opposite from each other being designated a top surface and a bottom surface of said extension arm;

said holder comprising first and second elongate congruent planar side members, each of said holder side members having a given width greater than said width of said extension arm and each of said holder side members having a length greater than said given width of said holder side members, said holder side members being positioned adjacent said opposite side surfaces of said extension arm with the longer side of each of said holder side members positioned so as to extend lengthwise of said extension arm;

as a consequence of said given width of each of said holder side members being greater than said given width of said extension arm, each of said holder side members defining a bottom margin that is located adjacent to said bottom surface and extends lengthwise of said extension arm, and each of said holder side members defining a top margin that is located adjacent to said top surface and extends lengthwise of said extension arm, said holder side members thereby having a pair of corresponding bottom margins and a pair of corresponding top margins;

a means rigidly securing together said corresponding bottom margins and a means rigidly securing together said corresponding top margins such that (a) said side surfaces of said extension arm are slidably confined between said holder side members and (b) said top and bottom surfaces of said extension arm are slidably confined between the said means securing together the said corresponding top margins and the said means securing together the said corresponding bottom margins;

said holder pivot axis perpendicularly intersecting said corresponding bottom margins between upper and lower ends of said bottom margins;

each of said holder side members being provided with a first slit extending parallel to said extension arm beginning at a first end of the holder side member and extending part way of the length of the holder side member past said holder pivot axis, said first slit being located between said extension arm and said bottom margin;

each of said holder side members being provided with a second slit extending parallel to said extension arm beginning at said first end of the holder side member and extending part way of the length of the holder side member past said holder pivot axis, said second slit being located between said extension arm and said top margin;

on each of said holder side members said first and second slits creating an elongate depressible segment of the holder side member having a width approximating said given width of said extension arm, each of said depressible segments being resiliently depressible against the adjacent side surface of said extension arm;

said lug means comprising a pair of lug members fixed to said upper end of said post member, said lug members having corresponding planar free end portions that extend further forwardly of said forward side of said post member and are spaced apart parallel to and equidistant from opposite sides of said plane of symmetry; said holder being mounted between and being pivotally secured to said free end portions of said lug members such that said common longitudinal axis of said holder and said extension arm is located within said plane of symmetry; said holder pivot axis perpendicularly intersecting said free end portions of said lug members spaced apart from said forward side of said post member such that said holder can be rotated to a folded position that positions said holder and said extension arm parallel to said forward side of said post member;

each of said corresponding free end portions of said lug members being provided with a screw-threaded hole, said screw-threaded holes being aligned on a common hole-center axis that perpendicularly intersects said free end portions of said lug members and passes through the said depressible segment of each of said holder side members at all rotated positions of said holder, said hole-center axis being thereby radially removed from said holder pivot axis;

at least one thumbscrew, said thumbscrew having a screw-threaded end that is received in one of said screw-threaded holes so as to be turnable against the adjacent depressible segment of said holder and thereby jam said last-recited depressible segment against the adjacent side surface of said extension arm, thereby simultaneously stopping pivotal movement of said holder and axial movement of said extension arm;

when said holder is in said pivotally folded position holding said extension arm parallel to said forward side of said post member, said screw-threaded end of said thumbscrew being turnable against said adjacent depressible segment near said first slit; and, when said holder is fully rotated towards said seat, said screw-threaded end of said thumbscrew being turnable against said adjacent depressible segment near said second slit.

4. A compactly foldable skywatcher's tripod as recited in claim 1, further comprising:

said base having a planar top surface;

said post member being fixed to said main member;

said main member and said post member each having a lateral side on a same side of said rider support;

an elongate steel rod that is stiff but capable of some degree of flexure, said rod being pivotally secured to said lateral side of said main member for rotation about a rod pivot axis that is perpendicular to said plane of symmetry and is located between said swivel axis and said post member nearest said swivel axis, said rod pivot axis demarcating a rearward segment of said rod that extends from said rod pivot axis to a rearward terminal of said rod that is adapted to abut said planar top surface of said base as a consequence of rotation of said rearward segment of said rod about said rod pivot axis in a direction toward said top surface of said base;

said rod pivot axis further demarcating a forward segment of said rod that extends from said rod pivot axis to a forward terminal of said rod that is positioned alongside said lateral side of said post member, said forward terminal of said rod being graspable by a person seated on said seat to effect rotation of said rearward segment of said rod, said forward segment of said rod being long enough to permit flexure of said forward segment and being longer than said rearward segment in order to multiply leverage for jamming said rearward terminal of said rod against said top surface of said base;

a rod holding bracket fixed to and extending laterally from said lateral side of said post member in engagement with said forward segment of said rod near said forward terminal of said rod, said rod holding bracket being provided with first and second detent notches within which said forward segment of said rod is alternatively positionable, said first detent notch being most distant from said rod pivot axis and serving to hold said rod in a first rotated position that holds said rearward terminal spaced apart from said top surface of said base so that said rider support is thereby freely rotatable about said swivel axis, said second detent notch being located nearer said rod pivot axis and serving to hold said rod in a second rotated position that holds said rearward terminal jammed against said top surface of said base so that said rider support is thereby stopped from rotating about said swivel axis, said first and second detent notches being spaced far enough apart from each other that relocation of said forward segment of said rod from said first detent notch to said second detent notch requires application of a force to said forward terminal that is great enough to force said flexure of said forward segment of said rod.

* * * * *